United States Patent [19]

Hatcher et al.

[11] 4,040,153

[45] Aug. 9, 1977

[54] METHOD AND APPARATUS FOR RESTRAINING A YARN WAD

[75] Inventors: Charles S. Hatcher, Greenville; Gary S. Atchley, Pauline, both of S.C.

[73] Assignee: Phillips Petroleum Company, Bartlesville, Okla.

[21] Appl. No.: 674,806

[22] Filed: Apr. 8, 1976

[51] Int. Cl.[2] ..... D02G 1/20; D02G 1/16; D02G 1/12

[52] U.S. Cl. ..... 28/221; 28/255; 28/267

[58] Field of Search ..... 28/1.3, 1.4, 1.6, 72.11, 28/72.12, 72.14

[56] References Cited

U.S. PATENT DOCUMENTS

| | | | |
|---|---|---|---|
| 3,693,222 | 9/1972 | Caffry | 28/1.6 |
| 3,778,872 | 12/1973 | Newton | 28/1.6 |

*Primary Examiner*—Louis K. Rimrodt

[57] ABSTRACT

Yarn in the form of a yarn wad is passed to a cooling and restraining zone wherein the surfaces of a plurality of balls are pressed directly against the surface of the yarn wad and simultaneously the movement of the balls relative to the yarn wad is restricted so that the balls are prevented from entering the yarn wad and the yarn wad is restrained due to the action of the balls upon the yarn wad. In addition, apparatus is provided useful in the method of the invention.

12 Claims, 4 Drawing Figures

METHOD AND APPARATUS FOR RESTRAINING A YARN WAD

BACKGROUND OF THE INVENTION

The invention relates to a method and apparatus for the production of yarn. In another aspect the invention relates to a method and apparatus for restraining a yarn wad.

Synthetic fibers are commonly produced by extruding molten polymer through a spinneret. In order to produce yarns which have properties approximating those of wool or other natural materials, it is common practice to subject the extrudate from the spinneret to a texturing process. This can be accomplished by a variety of procedures known in the art, such as stuffer-box crimping, false twisting, and fluid jet texturing. One particularly effective procedure involves passing the yarn to be textured and a high velocity fluid to a first passage, subsequently passing the yarn and the fluid to an enlarged passage wherein the yarn forms a yarn wad. The yarn wad is passed to a restraining zone in which the yarn wad is restrained and cooled. In the restraining zone individual stacked members, such as balls are used to exert a force on the yarn wad. The fluid escapes from the yarn through the voids between the stacked members and a textured yarn is removed from the restraining zone. Although this procedure produces a high quality textured yarn, a particularly troublesome problem involves loss of the stacked members from the restraining zone. Frequently, stacked members become entrained in the yarn wad and are carried away from the restraining zone. Also sudden disruptions in the texturing process cause the stacked members to be thrown from the restraining zone. In addition, operators occasionally knock stacked members from the restraining zone during string up and maintenance of the equipment. Further, recovering the stacked members from the floor and/or replacing them with new ones involves considerable expense, particularly where a number of such processing lines are used.

Although it would appear such a problem could be easily solved, this has not been the case. In order for the stacked members to function properly, they must be free to act upon the yarn wad, and in addition, the restraining zone containing the stacked members must be designed to allow the operator to easily string up and maintain the equipment. It has been very difficult to satisfy both of these conditions simultaneously. However, the present invention achieves such a result.

It is an object of the invention to restrain yarn.

Another object of the invention is to restrain and cool yarn textured using a fluid jet texturing process.

Another object of the invention is to eliminate the loss of stacked members from a restraining zone.

Still another object of the invention is to provide an apparatus useful for restraining yarn.

Yet another object of the invention is to provide an apparatus useful to cool and restrain yarn textured with a fluid jet wherein the apparatus contains individual stacked members which are not removed from the apparatus by the operation thereof.

Other aspects, objects, and advantages of the invention will be apparent to those skilled in the art upon studying the drawings, specification, and the appended claims.

SUMMARY OF THE INVENTION

In accordance with the invention a textured yarn in the form of a yarn wad is passed to a cooling and restraining zone and the surfaces of a plurality of balls are pressed directly against the surface of the yarn wad in the cooling and restraining zone and simultaneously the movement of the balls in the direction of the yarn wad is restricted so that the balls are prevented from entering the yarn wad and the yarn wad is restrained due to the action of the balls upon the yarn wad.

Further according to the invention, an apparatus comprises a first cylinder having first and second annular members and an inner wall; a second cylinder having first and second ends and inner and outer walls, the second cylinder being positioned inside the first cylinder with the ends of the second cylinder adjacent to and coaxially aligned with the annular portions of the annular members, the second cylinder having a plurality of troughs communicating the inner and outer surfaces thereof; and a plurality of balls of sufficient size to be retained between the inner wall of the first cylinder and the inner wall of the second cylinder but of sufficient size to permit the surfaces of a portion of the balls to extend beyond the inner surface of the second cylinder.

DETAILED DESCRIPTION OF THE INVENTION

Figure 1:
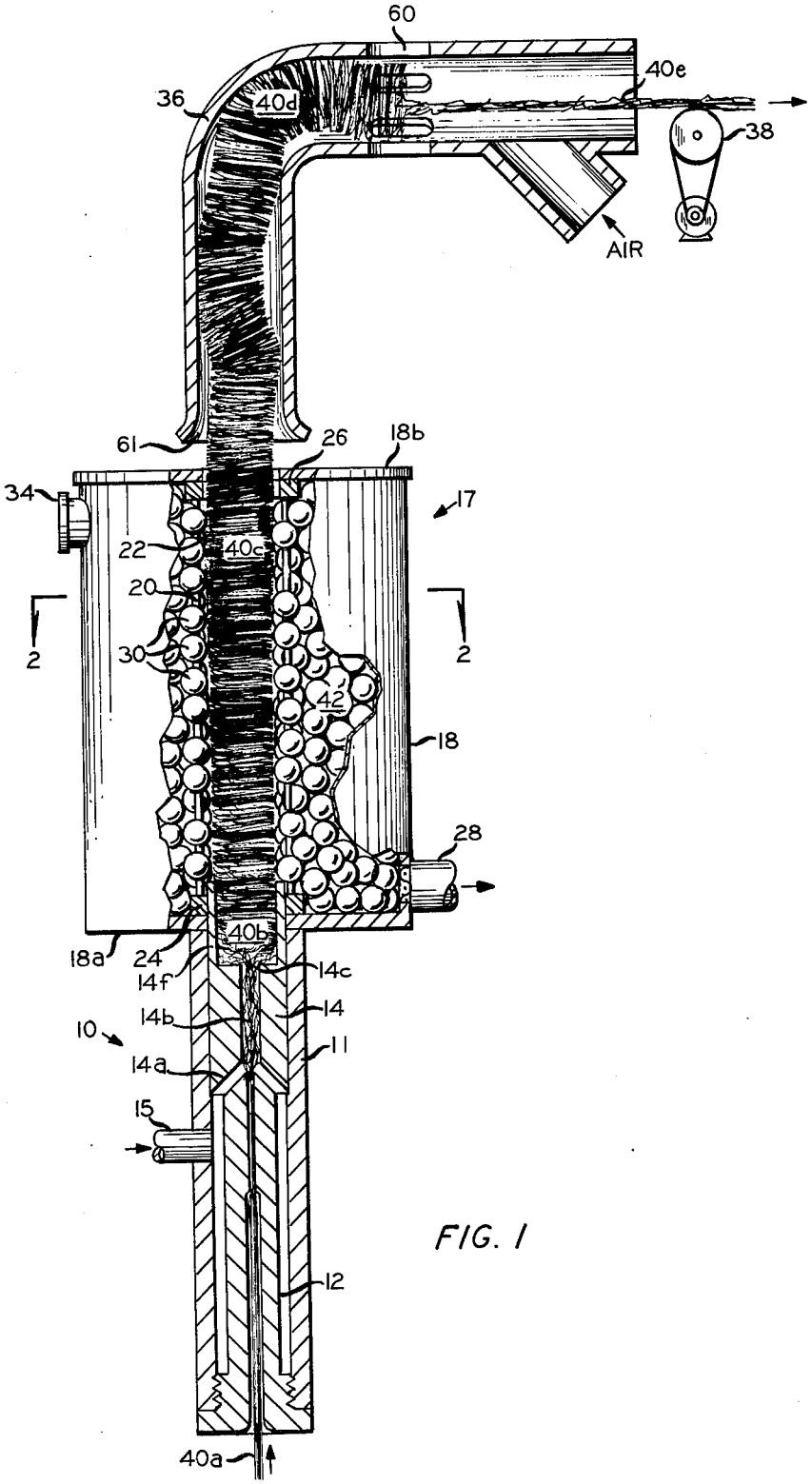
FIG. 1 illustrates an embodiment of the apparatus of this invention and a fluid jet which is employed to texture the yarn.

Referring now to the drawings and to FIG. 1 in particular, there is shown a crimping or texturing apparatus generally designated by reference numeral 10. This apparatus comprises an elongated sleeve 11 which has a hollow needle 12 positioned in the inlet section thereof. An elongated plug 14 is disposed in the outlet section of sleeve 11. Plug 14 has a central capillary opening **14*b* therethrough. The inlet of opening 14*b* is tapered to provide a seat 14*b* adjacent the tip of needle 12. The outlet of central opening 14*b* is 14*c*. A conduit 15 communicates with sleeve 11 to introduce a fluid, such as steam or air, at an elevated temperature in the annular space adjacent needle 12.** The above-described apparatus is generally known as a fluid jet for texturing yard and is suitable for use in the present invention.

Further according to the invention, an apparatus 17 for restraining a yard wad comprises a first cylinder 18 having a first annular member **18*a* and a second annular member 18*b* surrounding a second cylinder 20. In this embodiment second cylinder 20, shown more clearly in FIG. 3, comprises a plurality of rods 22 and a first ring 24 and a second ring 26. Ring 24 is adjacent to and coaxially aligned with annular member 18*a* and ring 26 is adjacent to and coaxially aligned with annular member 18*b*. Vent 28 allows fluids to be removed from cylinder 18.**

A plurality of balls 30 are positioned between first cylinder 18 and second cylinder 20. The plurality of passages or troughs 32 in cylinder 20, seen more clearly in FIG. 3, restricts the balls 30 to the general confines of ball space 42, defined as the space between the inner wall of cylinder 18, the annular member 18*a*, 18*b* and the inner wall of cylinder 20. Removal plug 34 or other suitable means permits access to the inside of cylinder 18 for the placing of balls 30 therein. Although balls 30 of FIG. 1 are the same size, it is within the scope of the invention to use balls two or more different sizes provided the smallest ball is too large to pass through openings 32.

FIG. 1 also shows quench tube 36 as known in the art positioned downstream of cylinder 18. Air or similar fluid is passed upstream through quench tube 36 and normally exits to the atmosphere at slots 60 and at end 61 of tube 36 immediate cylinder 18. Withdrawing means 38 is positioned downstream quench tube 36.

Figure 2:
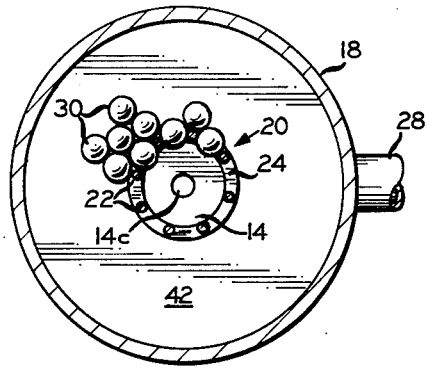
FIG. 2 is a cross-sectional plan view of the embodiment of FIG. 1 through lines 2—2.

FIG. 2 essentially shows the relative position of cylinder 18, cylinder 20 and elongated plug 14 with outlet 14*c* of central opening 14*b*.

In the operation of the apparatus of FIG. 1, one or more filaments 40*a* are inserted through needle 12 into the central passage of plug 14. The filaments can be delivered to the fluid jet 10 by any suitable means, not shown. In the normal start up operation, filaments 40*a* are threaded through the fluid jet 10, the restraining and cooling apparatus 17. Fluid which is generally a hot fluid such as steam is introduced through conduit 15 which flows upwardly through plug 14 into apparatus 17. In the embodiment of the invention shown in FIG. 1, apparatus 17 functions both as a restraining zone and a cooling zone. The fluid so introduced surrounds needle 12 which heats needle 12 which in turn heats filaments 40*a* as said filaments pass through needle 12. The fluid produces a jetting action in region 40*a* and passes along with yarn 40*a* through passage 14*b* both of which exit at 14*c*. The sudden increase in the size of the opening immediate 14*c* causes a zone 14*f* of substantial turbulence and the yard 40*b* in the turbulent zone passes downstream to form an elongated, generally cylindrical wad 40*c* within cylinder 20 of apparatus 17. The yarn wad 40*c* is restrained by the action of balls 30 thereon. In this particular embodiment the rods 22 of cylinder 20 prevent the balls 30 from entering into yarn wad 40*c* since passages 32 are too small for balls 30 to pass therethrough. FIG. 2 shows the relationship between the diameter of a ball and the size of passage 32.

It is pointed out that in order for apparatus 17 to function properly in restraining yarn wad 40*c*, passage 32 must be large enough to allow a substantial portion of the surface of balls 30 to press against yarn wad 40*c*. However, it is likewise pointed out that passage 32 must be small enough to restrain the balls within the ball space 42.

Yarn wad 40*c* then proceeds into quench tube 36 in which compressed air is flowing countercurrent to the direction of the yarn wad which causes yarn wad 40*d* to break up adjacent slots 60 to form textured yarn 40*e* which is pulled away by withdrawal means 38. Textured yarn 40*e* is subsequently processed as desired.

Figure 4:
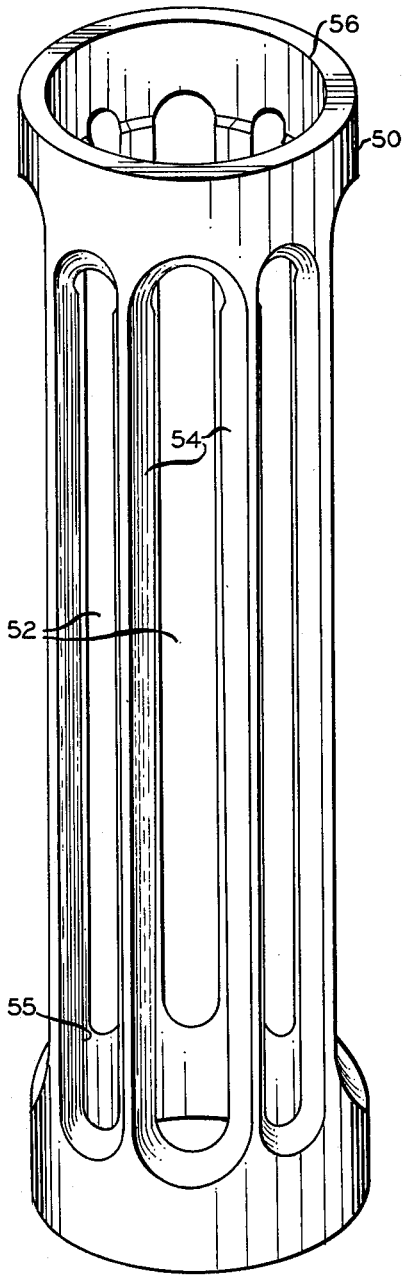
FIG. 4 illustrates another apparatus useful in the invention in lieu of the apparatus shown in FIG. 3.

In another embodiment of the invention a cylinder 50, such as that shown in FIG. 4, is positioned inside apparatus 17 replacing cylinder 20. Passages 52 are similar to passages 32 of cylinder 20 except that these passages or troughs can be milled to conform the converging sides 54 thereof to correspond to the surface of balls 30, thus allowing deeper penetration of a ball of a given diameter into the yarn wad as compared to cylinder 20 made of rods 22. It is desirable for the balls to have the greatest penetration possible without actually passing completely through passage 52 or passage 32 of cylinder 20 in order for the balls to have the greatest freedom to act upon and retrain the yarn wad. Cylinder 50 has a primary diameter 55 extending almost completely the length of the cylinder and a relief diameter 56 positioned at the outlet end of the cylinder. The relief diameter normally extends a distance sufficient to prevent the yarn from hanging up on the slotted portion of the cylinder but not so far as to enlarge the slotted portion so that balls are permitted to pass therethrough.

Figure 3:
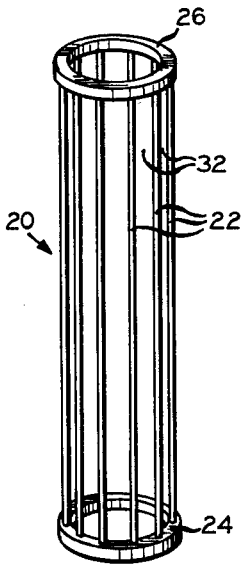
FIG. 3 illustrates an apparatus useful in the invention shown in FIG. 1.

The relief diameter concept is applied to the embodiment of cylinder 50 shown in FIG. 3 by enlarging ring 26 so that it circumscribes rods 22 and the inner surface of ring 26 is attached to the outer surface of said rods. Such a modification to the cylinder shown in FIG. 3 is recommended if the yarn wad tends to hang up on ring 26. If the relief diameter concept is not used in constructing cylinder 20, it is at least recommended that cylinder 20 be constructed such that the surface of rods 22 forming the inside surface of cylinder 20 be positioned adjacent the inside surface of annular members 24 and 26 in order to provide a smooth continuous surface over which the yarn wad 40*c* must pass. Since the action of the balls tends to push the yarn wad away from the surface of cylinder 20, use of the relief diameter concept is not always necessary in constructing cylinder 20 or cylinder 50 of FIG. 4, but it is preferred.

In a specific example carried out in accordance with the invention, second cylinder 20 was constructed similar to that shown as cylinder 50 in FIG. 4. The cylinder was constructed from an aluminum tube 5⅛ inches (13.02 cm) long which fitted over tube 14 a distance of 1 9/16 inches (3.97 cm). Six slots 3¾ inches (9.52 cm) long were milled in the outer surface of the cylinder starting ⅛ inches (0.318 cm) from the outlet end. The cylinder had a primary (inside) diameter of ⅝ inches (1.59 cm), an inside relief diameter ⅞ inches (2.22 cm), and an outside diameter of 1 inch (2.54 cm). The six slots were milled to an opening at the inner surface of the cylinder of 0.210 inches (0.53 cm) to control penetration of the 0.250 inches (0.635 cm) diameter steel balls. The opening of the slots on the outer surface of the cylinder was 0.250 inches (0.635 cm). The cylinder so constructed was placed on a texturing jet inside a cylinder 18 containing the ¼ inch steel balls.

Three ends of a drawn continuous filament polypropylene carpet yarn, having a total denier of 1800 and 126 filaments, were passed to the above-described texturing jet. The yarn was formed into a yarn wad which was restrained due to the action of the balls upon the yarn wad. The ¼ inch steel balls were effective in restraining the yarn wad and at the same time the steel balls were prevented from becoming entrained in the yarn wad or removed from the apparatus. The textured yarn produced was satisfactory for manufacturing carpets.

What is claimed is:

1. Apparatus comprising:

a first cylinder having first and second annular members and an inner wall;

a second cylinder having inner and outer walls, said second cylinder being positioned inside, adjacent to and coaxially aligned with said first cylinder, said second cylinder having a plurality of troughs communicating the inner and outer surfaces thereof; and a plurality of balls of sufficient size to be retained within the space defined by the inner wall and the first and second annular members of said first cylinder and the inner wall of said second cylinder but of sufficient size to permit the surfaces of a portion of the balls to extend beyond the inner surface of said second cylinder.

2. The apparatus of claim 1 further comprising a yarn texturing means having a yarn inlet and a yarn outlet, said yarn outlet being adjacent to and aligned with said first annular member of said first cylinder for receiving yarn into said second cylinder.

3. The apparatus of claim 2 wherein the yarn texturing means is a fluid jet.

4. The apparatus of claim 1 wherein said second cylinder comprises a plurality of rods and upper and lower rings, said rods being equally spaced one from another to form the cylinder and the ends of said rods being attached to said rings.

5. The apparatus of claim 2 wherein said second cylinder comprises a cylindrical tube having a plurality of parallel longitudinal troughs spaced equally around the surface thereof.

6. The apparatus of claim 5 wherein said second cylinder has a primary diameter and a relief diameter wherein the relief diameter extends from the end opposite the texturing means a distance sufficient to prevent yarn in the form of a yarn wad from hanging up on the slotted portion of the cylinder but not so far as to enlarge the slotted portion so that the balls are permitted to pass therethrough and wherein the primary diameter extends the remaining distance of the cylinder.

7. The apparatus of claim 6 wherein the longitudinal sides of troughs converge from the outer surface to the inner surface.

8. The apparatus of claim 7 wherein the cylindrical tube has an outside diameter of 1 inch (2.54 cm), a primary diameter of $\frac{5}{8}$ inch (1.59 cm), a relief diameter of $\frac{7}{8}$ inch (2.22 cm), a length of $5\frac{1}{8}$ inches (13.02 cm) and six troughs; the troughs were $3\frac{3}{4}$ inches long (9.52 cm) starting $\frac{1}{8}$ inch (0.318 cm) from the outlet end of the tube, 0.250 inch wide (0.635 cm) on the outside surface of the tube and 0.210 inch wide (0.53 cm) on the inside surface of the tube; and the balls had a diameter of 0.250 inch (0.635 cm).

9. The apparatus of claim 3 wherein a vent is positioned in said first cylinder near said first annular member, a removable plus is positioned in said first cylinder near said second annular member and different size balls are used.

10. Method comprising:

passing a textured yarn in the form of a yarn wad to a cooling and restraining zone; and pressing the surfaces of a plurality of balls directly against the surface of said yarn wad in said cooling and restraining zone and simultaneously restricting the movement of said balls in the direction of the yarn wad so that the balls are prevented from entering the yarn wad and the yarn wad is restrained due to the action of the balls upon the yarn wad.

11. The method of claim 10 further comprising passing a yarn to be textured to a texturing zone to produce a textured yarn in the form of a yarn wad.

12. The method of claim 11 wherein the texturing zone is a fluid jet texturing zone.

* * * * *